US007451776B2

(12) United States Patent
Chen

(10) Patent No.: US 7,451,776 B2
(45) Date of Patent: Nov. 18, 2008

(54) PORTABLE AWNING WITH A COLLAPSIBLE SUPPORTING FRAME

(75) Inventor: Nengsen Chen, No. 811, Oriental Ave., Linhai, Zhejiang (CN) 317004

(73) Assignee: Nengsen Chen (CN)

( * ) Notice: Subject to any disclaimer, the term of this patent is extended or adjusted under 35 U.S.C. 154(b) by 0 days.

(21) Appl. No.: 11/703,913

(22) Filed: Feb. 7, 2007

(65) Prior Publication Data

US 2008/0017235 A1 Jan. 24, 2008

(30) Foreign Application Priority Data

Jul. 19, 2006 (CN) ..... 2006 2 0105806 U

(51) Int. Cl.
*E04H 15/44* (2006.01)
*E04H 15/14* (2006.01)

(52) U.S. Cl. ..... 135/147; 135/94; 135/135; 135/98; 52/82; 52/83

(58) Field of Classification Search ..... 135/91, 135/98, 147, 157–159, 117, 93–94, 130–131, 135/135, 115; 52/82, 83, 79.5, 79.6, 643, 52/663, 696, 641; D25/56
See application file for complete search history.

(56) References Cited

U.S. PATENT DOCUMENTS 312,446 A * 2/1885 Drake ..... 135/25.3
1,219,847 A * 3/1917 Nettenstrom ..... 135/98
2,530,765 A * 11/1950 Greenup ..... 135/98
2,993,216 A * 7/1961 Casey ..... 135/21
3,455,310 A * 7/1969 Peterson ..... 135/98
6,283,136 B1 * 9/2001 Chen ..... 135/144
6,575,100 B2 * 6/2003 Faucher et al. ..... 104/126
D482,130 S * 11/2003 Wu ..... D25/56
6,692,135 B2 * 2/2004 Li ..... 362/102
6,745,521 B1 * 6/2004 Klemming ..... 52/79.6
6,761,181 B1 * 7/2004 Tseng ..... 135/133
D506,262 S * 6/2005 Wang ..... D25/56
6,923,195 B2 * 8/2005 Tseng ..... 135/122
7,207,344 B2 * 4/2007 Wu ..... 135/158
7,308,901 B2 * 12/2007 Meyer ..... 135/158
7,314,055 B2 * 1/2008 Guo et al. ..... 135/156

FOREIGN PATENT DOCUMENTS

CN 2672196 Y 1/2005

* cited by examiner

*Primary Examiner*—Winnie Yip
(74) *Attorney, Agent, or Firm*—Finnegan, Henderson, Farabow, Garrett & Dunner, LLP

(57) ABSTRACT

An awning includes a plurality of peripheral poles, a plurality of iron screens, and a collapsible supporting frame. A lower top cloth covers a lower top frame of the collapsible supporting frame and is attached in such a way as to define a central opening, and an upper top cloth covers an upper top frame of the collapsible supporting frame. The upper top cloth has an area of projection larger than the area of the central opening of the lower top cloth. The upper umbrella disk and the middle umbrella disk are moveable into position by a positioning fixture.

6 Claims, 3 Drawing Sheets

PORTABLE AWNING WITH A COLLAPSIBLE SUPPORTING FRAME

DESCRIPTION OF THE INVENTION

1. Field of the Invention

The present disclosure relates to a portable awning for outdoor use, and more particularly, to a portable awning with a collapsible supporting frame.

2. Background of the Invention

Chinese patent publication No. CN2672196 discloses "A Screen of Awning and Awning of Combined Type Using the Screen of Awning." This awning comprises a top pole member and several supporting screens. The top pole member includes several top poles. Each supporting screen includes two mutually angled vertical frames. Each vertical frame includes a central vertical pole and two auxiliary vertical poles. The central vertical pole is positioned between the two auxiliary vertical poles, wherein the central vertical pole is parallel to the auxiliary vertical poles. Upper horizontal poles and lower horizontal poles, which are parallel to each other, are positioned between the central vertical pole and each auxiliary vertical pole. The upper horizontal poles and the lower horizontal poles are connected pivotally to the central vertical pole at one end and to the auxiliary vertical poles at the other end. Decorative features may be added to the areas surrounded by the central vertical pole, the auxiliary vertical poles, the upper horizontal poles, and the lower horizontal poles. Plug sections are provided on the top ends of the central vertical pole and the auxiliary vertical poles, and socket sections, which include some buckling mechanisms, are provided on the top poles thereon, so that the plug sections and the socket sections can engage with each other. The advantage of this structure is that it can be folded into a compact size to occupy as little space as possible. Also, the cost of transportation can be significantly decreased and, therefore, the product's competitive power within the marketplace can be greatly increased. However, the shortcoming of this awning is that if a strong wind blows on it, the entire structure may be in danger of being blown over. As a result, the integral stability of the structure is not good. In addition, its configuration is complicated and, therefore, it is difficult to assemble or disassemble.

SUMMARY OF THE INVENTION

In order to overcome the shortcomings of the collapsible-type awning of the prior art, the present disclosure provides a portable awning with a collapsible supporting frame that not only provides good integral stability, but also has a simple configuration that is easy to assemble and disassemble.

The technical solution for solving the problems of the prior art discussed above is to propose a portable awning with a collapsible supporting frame comprising periphery-pole sections and several iron screens. Each periphery-pole section includes several periphery poles, and each iron screen includes two mutually angled, iron vertical frames. Decorative features may be added to these vertical frames. The collapsible supporting frame is connected and fixed to the periphery-pole sections. A lower top cloth covers a lower top frame of the collapsible supporting frame and is attached in such a way as to define a central opening, and an upper top cloth covers and is attached to an upper top frame of the collapsible supporting frame.

The upper top frame and lower top frame of the collapsible supporting frame are connected by four connecting pieces and a connecting tube. These four connecting pieces are connected pivotally to the middle portions of the four top poles of the upper top frame at their upper ends and to the long top poles of the lower top frame at their lower ends. An upper umbrella disk is fixed to the top end of the connecting tube, and a middle umbrella disk is fixed to the middle portion of the connecting tube. The upper and middle umbrella disks are moved into position by a positioning fixture therebetween, and this section, together with every combination of the connecting piece, the top pole, and the long top pole of the lower top frame, forms the shape of a substantial parallelogram.

The upper top frame may include four top poles connected pivotally to the upper umbrella disk.

The lower top frame may include four long top poles and four short top poles of the lower top frame, which are all connected pivotally to the middle umbrella disk, and eight supporting poles, which are connected pivotally to a lower umbrella disk at one end and to the middle portions of these long and short top poles at the other end.

A sleeve provided for insertion of the lower end of the connection tube is fixed to said lower umbrella disk. A lamp also may be provided on the lower umbrella disk.

The upper top cloth has an area of projection larger than the area of the central opening of the lower top cloth, and covers this opening.

The long top pole of the lower top frame has a structure that allows it to be lengthened or shortened, wherein a bushing is fixed to the end of an outer tube, a slider is fixed to the end of an inner tube, and an elastic pressing buckle equipped with a button is fitted under the slider in the inner tube, with the button projecting out of the corresponding holes in the walls of the inner tube and the outer tube.

One of the advantages of the present disclosure is that is allows the air to circulate through the central opening of the lower top cloth. If any wind blows on the awning, the wind flows through this central opening of the lower top cloth. As a result, even though the force of the wind may be strong, the awning is able to maintain its stability. The upper top cloth has an area of projection larger than the area of the central opening in the lower top cloth, so that it can keep out the rain. The upper umbrella disk and the middle umbrella disk are moved into position by a positioning fixture, and this section, together with every combination of the connecting piece, the top pole, and the long top pole of the lower top frame, forms a substantial parallelogram. This type of structure allows the collapsible supporting frame to be drawn in or spread out completely like an umbrella. The configuration thereof is simple, it can be easily assembled or disassembled, and it can be reduced to a compact size, so that it can be easily stored and carried. In addition, it has a beautiful outward appearance with decorative features.

BRIEF DESCRIPTION OF THE DRAWINGS

The embodiment of the present disclosure will be described in conjunction with the following drawings.

In these drawings, the reference numbers are as follows: (1) upper top cloth, (2) collapsible supporting frame, (3) lower top cloth, (4) iron screen, (5) center opening, (10) periphery pole section, (12) periphery poles, (14) vertical frames, (21) lower top frame, (22) upper top frame, (100) awning, (101) long top pole, (102) holder, (103) top pole, (104) connecting piece, (105) upper umbrella disk, (106) positioning fixture, (107) middle umbrella disk, (108) connecting tube, (109) short top pole, (110) cloth hook, (111) lower umbrella disk, (112) lamp, (113) supporting pole, (114) inner tube, (115) bushing, (116) pressing buckle, (117) slider, and (118) outer tube.

DESCRIPTION OF THE EMBODIMENTS

Figure 1:
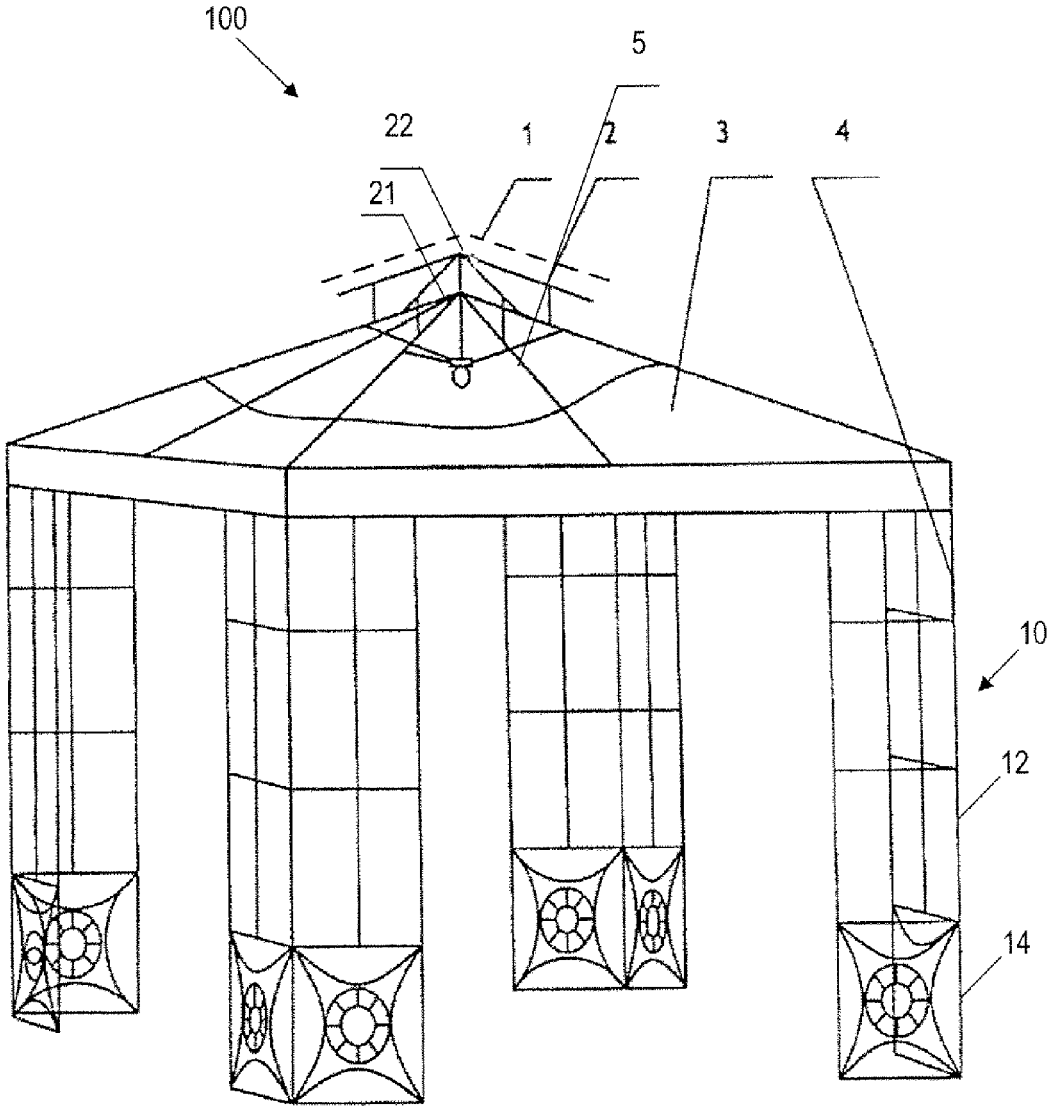
FIG. 1 is a schematic view of the present disclosure.

FIG. 1 shows a schematic view of the present disclosure. An awning 100 with a collapsible supporting frame 2 may include a periphery-pole section 10 and several iron screens 4. The periphery-pole section 10 may include several periphery poles 12, and each iron screen 4 may include two mutually angled iron vertical frames 14. Decorative features may be added to these vertical frames 14. The collapsible supporting frame 2 may be connected and fixed to the periphery-pole section 10. A lower top cloth 3 covers a lower top frame 21 of the collapsible supporting frame 2 and is attached in such a way as to define a central opening 5. An upper top cloth 1 covers an upper top frame 22 of the collapsible supporting frame 2 and is attached therewith. Upper top cloth 1 has an area of projection larger than the area of the central opening 5 of the lower top cloth 3, and ensures that the central opening 5 is covered.

Figure 2:
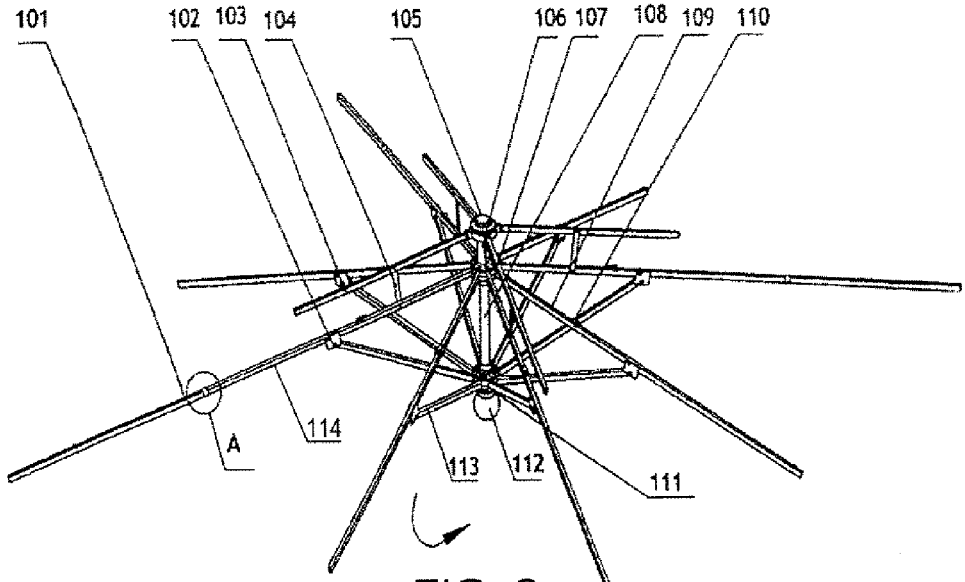
FIG. 2 is a schematic structural view of the collapsible supporting frame of the present disclosure shown in an open state.
Figure 3:
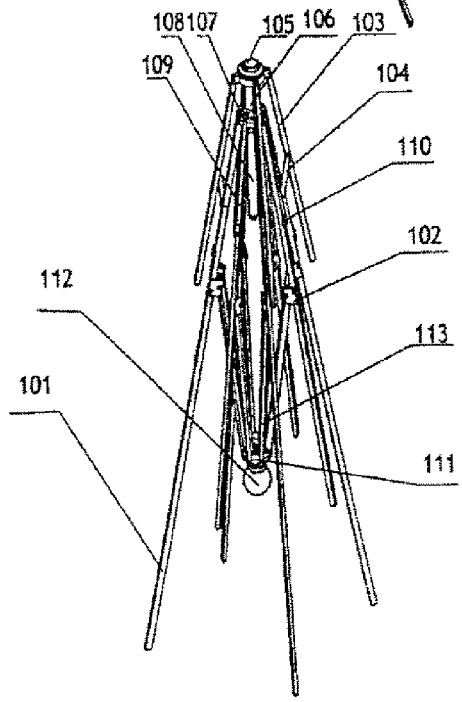
FIG. 3 is a schematic structural view of the collapsible supporting frame of the present disclosure shown in a folded state.

As shown in FIGS. 2 and 3, the upper top frame 22 and the lower top frame 21 of the collapsible supporting frame 2 are connected by four connecting pieces 104 and a connecting tube 108. Said upper top frame is comprised of four top poles 103 connected pivotally to an upper umbrella disk 105. Said lower top frame is comprised of four long top poles 101, four short top poles 109, and eight supporting poles 113, wherein the four long top poles 101 and the four short top poles 109 are all connected pivotally to a middle umbrella disk 107. The four long top poles 101 are supported at the four corners of the awning, the four short top poles 109 are supported on top of the periphery poles, and the eight supporting poles 113 are connected pivotally to a lower umbrella disk 111 at one end, and to the middle portions of long top poles 101 and short top poles 109 by holders 102 at the other end. Cloth hooks 101 are fixed in the middle portions of long top poles 101 and short top poles 109 of the lower top frame to facilitate attaching or taking off lower top cloth 3 quickly. Four connecting pieces 104 are connected pivotally to the middle portions of the four top poles 103 of the upper top frame at their upper ends and to the long top poles 101 of the lower top frame at their lower ends. Upper umbrella disk 105 is fixed to the top end of connecting tube 108, and middle umbrella disk 107 is fixed to the middle portion of connecting tube 108, with these two being moved into position by positioning fixture 106 therebetween. This section, together with every combination of connecting piece 104, top pole 103, and long top pole 101 of the lower top frame, forms the shape of a parallelogram. A sleeve provided for insertion of the lower end of connecting tube 108 is fixed to lower umbrella disk 111. The lower end of connecting tube 108 is tapered into the shape of a truncated cone to facilitate insertion. A lamp 112 for use at night may be provided on lower umbrella disk 111.

Figure 4:
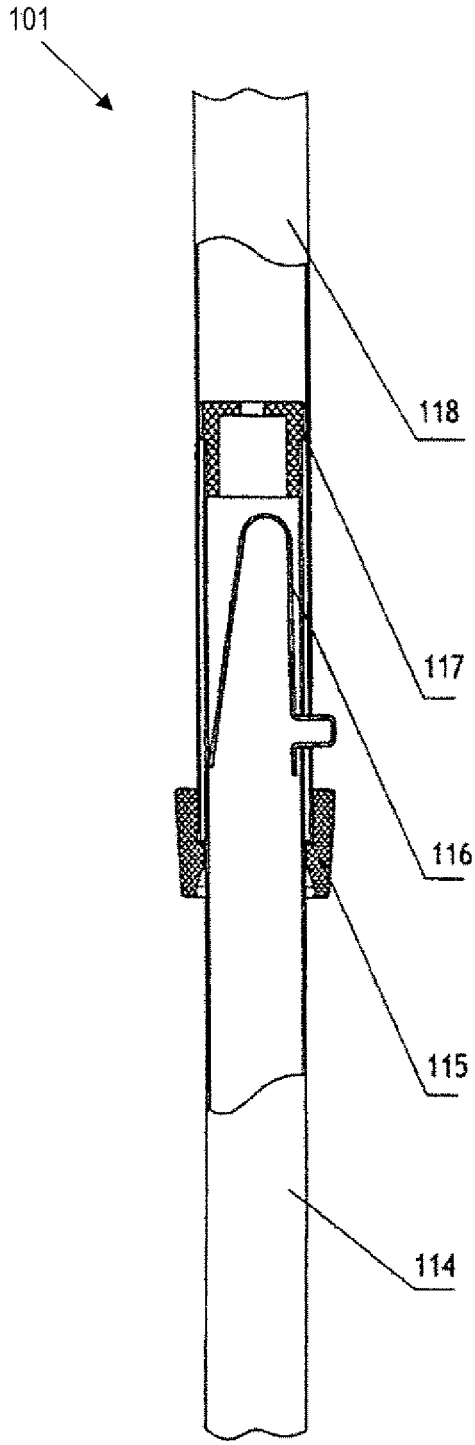
FIG. 4 is an enlarged sectional view of portion A shown in FIG. 2.

As shown in FIG. 4, long top pole 101 of the lower top frame has a structure that can be lengthened or shortened, wherein bushing 115 is fixed to the end of outer tube 118, slider 117 is fixed to the end of inner tube 114, and elastic pressing buckle 116, which is equipped with a button, is fitted under slider 117 in inner tube 114. The button of elastic pressing buckle 116 projects out of the corresponding holes in the walls of inner tube 114 and outer tube 118. When someone presses pressing buckle 116 into the wall of outer tube 118 and pushes or pulls inner tube 114 into or from outer tube 118, inner tube 114 slides into outer tube 118 with plastic slider 117. The plastic bushing 115 leans against outer tube 118 and inner tube 114, respectively, to facilitate the lengthening and shortening of the tubes, wherein elastic pressing buckle 116 functions as a positioner. In this way, when shortened, each of long top poles 101 of the lower top frame has the same length as that of each of short top poles 109 to facilitate packaging and storing.

When the awning is used outdoors at places for entertainment, its collapsible supporting frame can be spread out or drawn in freely without assembly or disassembly. No tools are necessary, because the upper umbrella disk and the middle umbrella disk are moved into position by a positioning fixture. This section, together with every combination of the connecting piece, the top pole, and the long top pole of the lower top frame, forms the shape of a parallelogram. The integral stability of the whole awning is increased, because the wind passes through the central opening of the lower top cloth and, therefore, prevents the structure from blowing over, even though the force of the wind may be strong. In addition, the awning with a collapsible supporting frame has a simple configuration that makes it easy to reduce to a compact size for storing and carrying. It also has a beautiful outward appearance.

The present disclosure is not limited to the preferred embodiment mentioned above. For example, the upper top cloth can be square or circular in shape, or any other shape, as long as the central opening of the lower top cloth can be covered. All modifications and changes to the description of the present disclosure will fall under the scope of the appendant claims thereof.

What is claimed is:

1. An awning comprising:

a collapsible supporting frame having a lower top frame and an upper top frame;

a plurality of periphery pole sections including a plurality of upright poles, wherein the collapsible supporting frame is supported by the periphery pole sections;

a lower top cloth covering the lower top frame of the collapsible supporting frame and defining a central opening;

an upper top cloth covering the upper top frame of the collapsible supporting frame;

wherein the upper top frame and lower top frame of the collapsible supporting frame are connected by a connecting tube;

wherein the upper top frame includes a plurality of top poles pivotally connected to an upper umbrella disk mounted on the connecting tube, wherein the lower top frame includes relatively long top poles and relatively short top poles, which are all pivotally connected to a middle umbrella disk mounted on the connecting tube, and a plurality of supporting poles, which are pivotally connected to a lower umbrella disk mounted on the connecting tube and to the middle portions of the relatively long and short top poles of the lower top frame respectively, and the long and short top poles of the lower top frame are connected to and supported by the periphery pole sections.

2. An awning according to claim 1 further comprising iron screens attached to the periphery pole sections.

3. The awning according to claim 1, wherein the upper top frame and lower top frame are connected by connecting pieces;

each connecting piece being pivotally connected between the top poles of the upper top frame and the long top poles of the lower top frame.

4. The awning according to claim 1, further including a lamp which is provided on the lower umbrella disk.

5. The awning according to claim 1, wherein the upper top cloth has an area of projection larger than the area of the central opening of the lower top cloth.

6. The awning according to claim 1, wherein the relatively long top poles of the lower top frame are extendable, each of the relatively long top poles including a bushing attached to an outer tube, a slider attached to an inner tube, and a pressing buckle fitted under the slider.

* * * * *